US010053313B2

(12) United States Patent
Akamatsu

(10) Patent No.: US 10,053,313 B2
(45) Date of Patent: Aug. 21, 2018

(54) IMAGE FORMING APPARATUS

(71) Applicant: KYOCERA Document Solutions Inc., Osaka (JP)

(72) Inventor: Shinji Akamatsu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/782,110

(22) Filed: Oct. 12, 2017

(65) Prior Publication Data

US 2018/0105378 A1 Apr. 19, 2018

(30) Foreign Application Priority Data

Oct. 18, 2016 (JP) ..... 2016-204340

(51) Int. Cl.
*B65H 1/18* (2006.01)
*B65H 1/14* (2006.01)
*B65H 7/20* (2006.01)

(52) U.S. Cl.
CPC ..... *B65H 1/18* (2013.01); *B65H 1/14* (2013.01); *B65H 7/20* (2013.01); *B65H 2511/152* (2013.01); *B65H 2511/30* (2013.01); *B65H 2553/412* (2013.01); *B65H 2553/612* (2013.01)

(58) Field of Classification Search
CPC ..... B65H 1/18; B65H 7/04; B65H 2511/152; B65H 2511/30; B65H 2553/412; B65H 2553/60; B65H 2553/61; B65H 2553/612
See application file for complete search history.

(56) References Cited

U.S. PATENT DOCUMENTS 6,279,899 B1 * 8/2001 Coffey ..... B65H 31/26 270/58.02
7,374,163 B2 * 5/2008 Cook ..... B65H 1/00 271/145
7,588,244 B2 * 9/2009 Kawamoto ..... B65H 1/18 271/152
7,597,313 B2 * 10/2009 Dan ..... B41J 13/103 271/10.03
7,753,366 B2 * 7/2010 Kawanishi ..... B65H 1/18 271/152
7,971,868 B2 * 7/2011 Matsushima ..... B65H 1/14 271/117

(Continued)

FOREIGN PATENT DOCUMENTS

JP H05-229674 A 9/1993

*Primary Examiner* — Jeremy R Severson
(74) *Attorney, Agent, or Firm* — Studebaker & Brackett PC

(57) ABSTRACT

An image forming apparatus includes a lift plate, an actuator, a photosensor, and a controller. Paper is placed on the lift plate. The lift plate is driven to increase a first inclination angle in response to a decrease in a residual amount of the paper placed on the lift plate. The first inclination angle indicates an angle of inclination of the lift plate with respect to a horizontal plane. A second inclination angle indicating an angle of inclination of the actuator with respect to the horizontal plane increases in response to an increase in the first inclination angle. The actuator increases or decreases a transmitted light quantity along with an increase in the second inclination angle. The photosensor detects the transmitted light quantity. The controller calculates the residual amount of the paper on the basis of the transmitted light quantity.

12 Claims, 10 Drawing Sheets

(56) References Cited

U.S. PATENT DOCUMENTS

| | | | | |
|---|---|---|---|---|
| 7,971,870 | B2 * | 7/2011 | Lee | B65H 7/04 271/145 |
| 8,042,801 | B2 * | 10/2011 | You | B65H 1/266 271/147 |
| 8,439,351 | B1 * | 5/2013 | Burke | B65H 3/0684 271/110 |
| 9,024,984 | B2 * | 5/2015 | Akatsuka | B41J 11/0095 271/147 |
| 9,670,015 | B2 * | 6/2017 | Hara | B65H 1/266 |

* cited by examiner

IMAGE FORMING APPARATUS

INCORPORATION BY REFERENCE

The present application claims priority under 35 U.S.C. § 119 to Japanese Patent Application No. 2016-204340, filed on Oct. 18, 2016. The contents of this application are incorporated herein by reference in their entirety.

BACKGROUND

The present disclosure relates to an image forming apparatus.

A feeding device includes a feeding roller, a bottom plate, a pressing lever, and a residual amount detecting sensor. Paper is placed on the bottom plate. The feeding roller feeds the paper placed on the bottom plate. The pressing lever presses the bottom plate upward such that an upper surface of the paper on the bottom plate comes into contact with the feeding roller. The residual amount detecting sensor detects a residual amount of the paper from an amount of movement of the pressing lever. Specifically, the residual amount detecting sensor for the paper includes an encoder and a photosensor. The encoder is a fan-shaped plate and fixed to a rotation center of a rotation shaft of the pressing lever. The encoder has radially extending slits arranged along the circumference of the encoder. The photosensor detects a rotation angle of the rotation shaft of the pressing lever by counting the number of movement of the slits.

SUMMARY

An image forming apparatus according to the present disclosure includes a lift plate, an actuator, a photosensor, and a controller. The lift plate is driven to increase a first inclination angle in response to a decrease in a residual amount of a recording medium placed on the lift plate. The first inclination angle indicates an angle of inclination of the lift plate with respect to a horizontal plane. A second inclination angle indicating an angle of inclination of the actuator with respect to the horizontal plane increases in response to an increase in the first inclination angle. The photosensor detects a transmitted light quantity. The actuator increases or decreases the transmitted light quantity in response to an increase in the second inclination angle. The controller calculates the residual amount of the recording medium on the basis of the transmitted light quantity.

DETAILED DESCRIPTION

Figure 1:
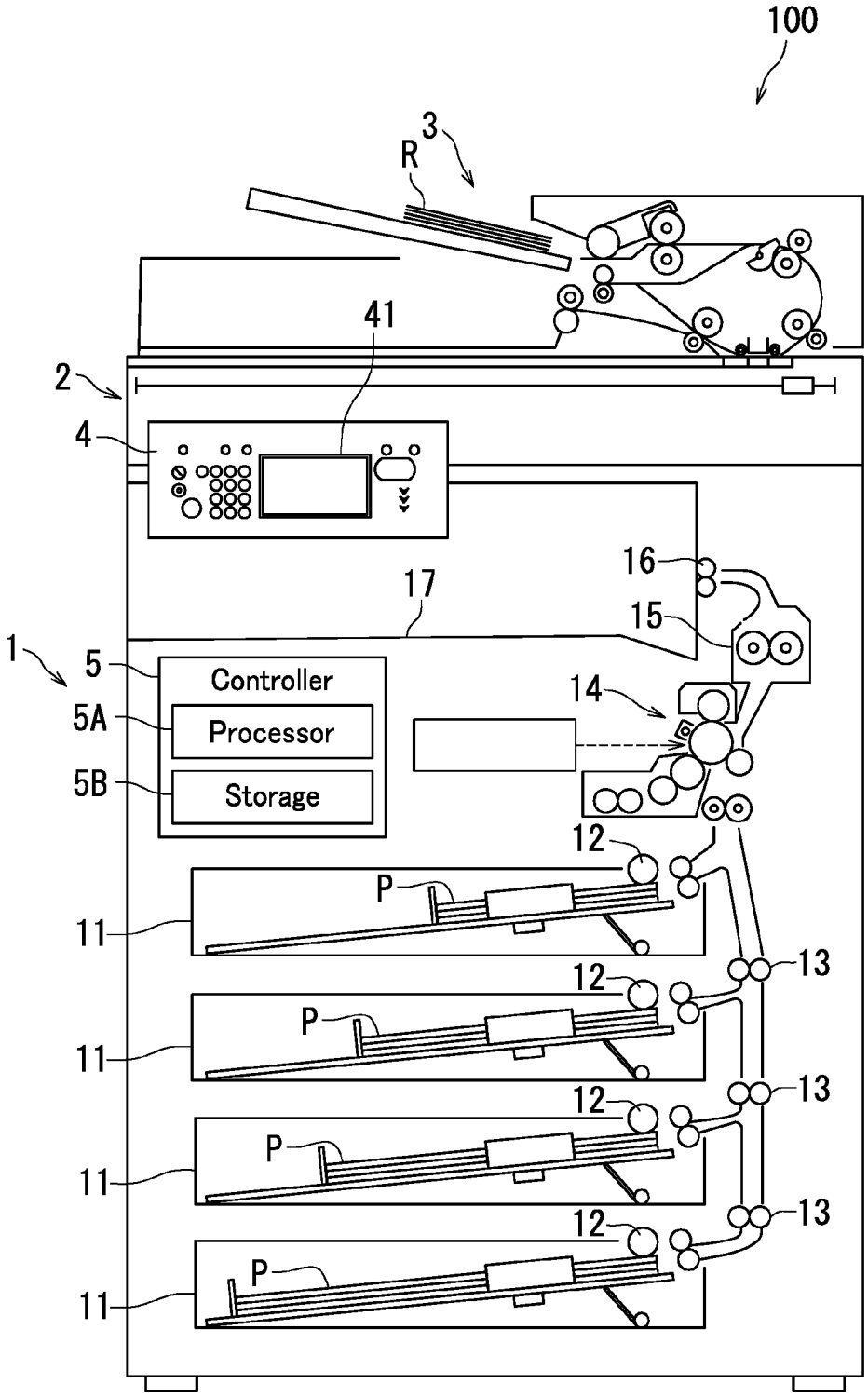
FIG. 1 is a side view illustrating configuration of an image forming apparatus according to an embodiment of the present disclosure.

The following describes an embodiment of the present disclosure with reference to the drawings (FIGS. 1 to 10). Note that in the drawings, elements that are the same or substantially equivalent are labelled using the same reference signs and explanation thereof will not be repeated.

First, an image forming apparatus 100 according to the embodiment of the present disclosure will be described with reference to FIG. 1. FIG. 1 is a diagram illustrating configuration of the image forming apparatus 100. As illustrated in FIG. 1, the image forming apparatus 100 is a multifunction peripheral. The image forming apparatus 100 includes an image forming unit 1, an image reading unit 2, a document conveyance unit 3, an operation panel 4, and a controller 5.

The image forming unit 1 forms an image on paper P (a recording medium). The image reading unit 2 reads an image formed on a document R and generates a read image. The document conveyance unit 3 conveys the document R to the image reading unit 2.

The operation panel 4 includes a touch panel 41. The touch panel 41 includes for example a liquid crystal display (LCD) and displays various images. The touch panel 41 further includes a touch sensor and receives an operation performed by a user. The touch panel 41 corresponds to an example of a "display section".

The controller 5 includes a processor 5A and storage 5B. The processor 5A includes for example a central processing unit (CPU). The storage 5B includes a memory such as a semiconductor memory and may include a hard disk drive (HDD). The storage 5B stores therein a control program. Also, the storage 5B stores therein a thickness TP per sheet of the paper P.

Also, the image forming unit 1 includes a feeding cassette 11, a pickup roller 12, a conveyance roller pair 13, an image forming device 14, a fixing device 15, an ejection roller pair 16, and an exit tray 17. The paper P fed from the feeding cassette 11 by the pickup roller 12 is conveyed by the conveyance roller pair 13 to the image forming device 14.

The image forming device 14 forms an image on the paper P. The image forming device 14 includes a photosensitive drum, a charger, a light exposure section, a development section, and a transfer roller.

The paper P on which the image has been formed is conveyed to the fixing device 15. The image formed on the paper P is fixed to the paper P through application of heat and pressure to the paper P by the fixing device 15. The paper P to which the image has been fixed is ejected to the exit tray 17 by the ejection roller pair 16.

Figure 2:
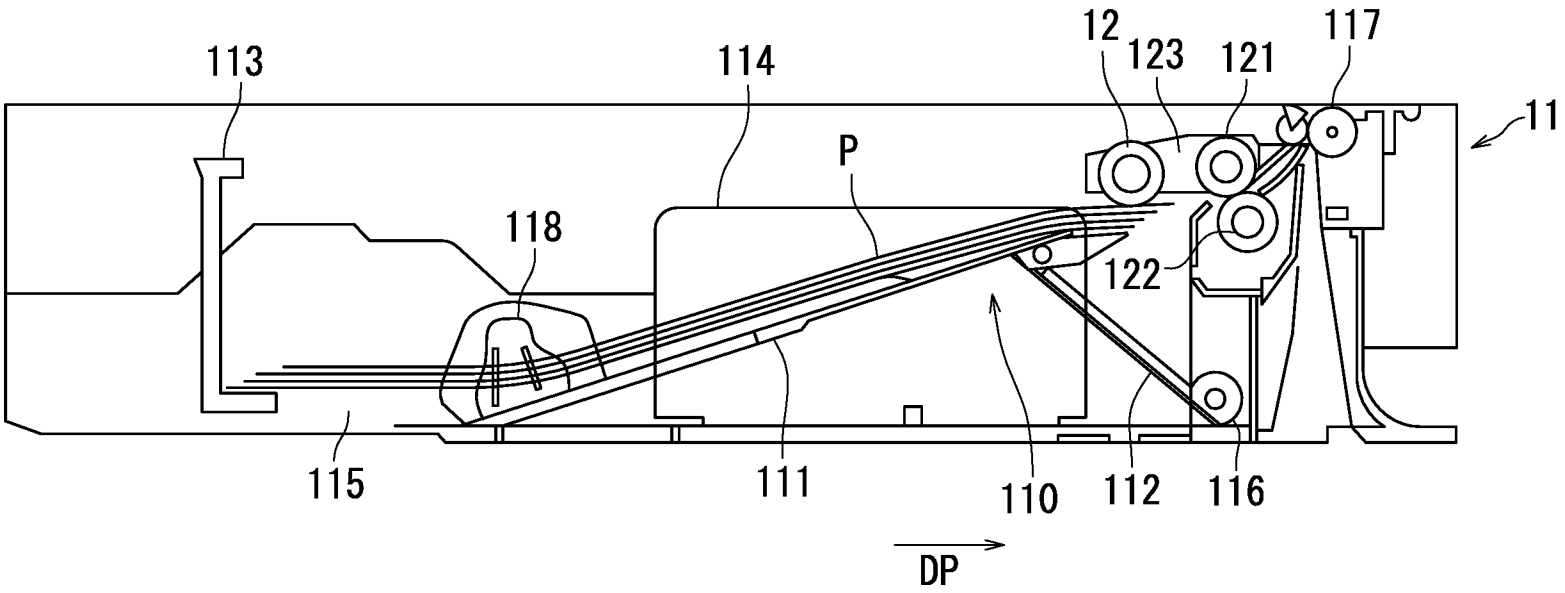
FIG. 2 is a side view illustrating configuration of a feeding cassette according to an embodiment of the present disclosure.

Next, configuration of the feeding cassette 11 will be described with reference to FIGS. 1 and 2. FIG. 2 is a side view illustrating the configuration of the feeding cassette 11. As illustrated in FIG. 2, the feeding cassette 11 includes a lift mechanism 110, a rear edge guide 113, a side edge guide pair 114, a sheet accommodation section 115, a conveyance roller 117, a feeding roller 121, a retard roller 122, and a support member 123.

The lift mechanism 110 presses the paper P placed thereon against the pickup roller 12. The lift mechanism 110 includes a lift plate 111, an uplift member 112, a drive shaft 116, and a support portion 118.

The lift plate 111 is located on the inner bottom surface of the sheet accommodation section 115 of the feeding cassette 11. Plural sheets of the paper P are placed on the lift plate 111. An upstream end of the lift plate 111 in a feeding direction of the paper P (the left end in FIG. 2) is turnably supported by the support portion 118. That is, the lift plate 111 is turnably supported by the support portion 118 within the sheet accommodation section 115, and a downstream end of the lift plate 111 in the feeding direction of the paper P is a free end. The support portion 118 is provided at each of end positions of the sheet accommodation section 115 opposed to each other in a width direction of the paper P (a direction orthogonal to the feeding direction of the paper P).

The rear edge guide 113 aligns the rear edge of the paper P. The rear edge guide 113 is provided so as to be movable in a direction parallel to the feeding direction of the paper P. The side edge guide pair 114 determines a position of the paper P accommodated in the sheet accommodation section 115 in the width direction of the paper P. The side edge guide pair 114 is provided so as to be movable in the width direction of the paper P along a guide rail not illustrated. By moving the rear edge guide 113 and the side edge guide pair 114 in accordance with the size of the paper P, the paper P is accommodated in a predetermined position within the feeding cassette 11.

The drive shaft 116 and the uplift member 112 are located below and downstream of the lift plate 111 in the feeding direction of the paper P. The drive shaft 116 and the uplift member 112 move the lift plate 111 between a "feeding position" and a "retraction position". The "feeding position" refers to a position of the lift plate 111 (position illustrated in FIG. 2) at which the uppermost sheet of the paper P placed on the lift plate 111 is in contact with the pickup roller 12 and can be fed. The "retraction position" refers to a position of the lift plate 111 descended to a descent limit. The drive shaft 116 is driven to rotate by a drive motor not illustrated.

The paper P picked up by the pickup roller 12 is fed by the feeding roller 121 to the conveyance roller 117. The feeding roller 121 rotates in a direction to convey the paper P downstream in the feeding direction of the paper P (rightward in FIG. 2). The conveyance roller 117 is located downstream of the feeding roller 121 in the feeding direction of the paper P. The conveyance roller 117 conveys the paper P to the conveyance roller pair 13 (see FIG. 1).

The retard roller 122 is located below the feeding roller 121. Also, the retard roller 122 is in contact with the feeding roller 121. Contrary to the feeding roller 121, the retard roller 122 rotates in a direction to send back the paper P upstream in the feeding direction of the paper P (leftward in FIG. 2). Even in a situation in which plural sheets of the paper P are picked up by the pickup roller 12 at a time, the retard roller 122 prevents sheets of the paper P other than the uppermost sheet from being fed to the conveyance roller 117. Therefore, only the uppermost sheet of the paper P is conveyed by the feeding roller 121 to the conveyance roller 117.

The support member 123 supports the pickup roller 12 such that the pickup roller 12 is turnable about a rotation shaft of the feeding roller 121. The pickup roller 12 is configured to be turnable about the rotation shaft of the feeding roller 121.

Figure 3:
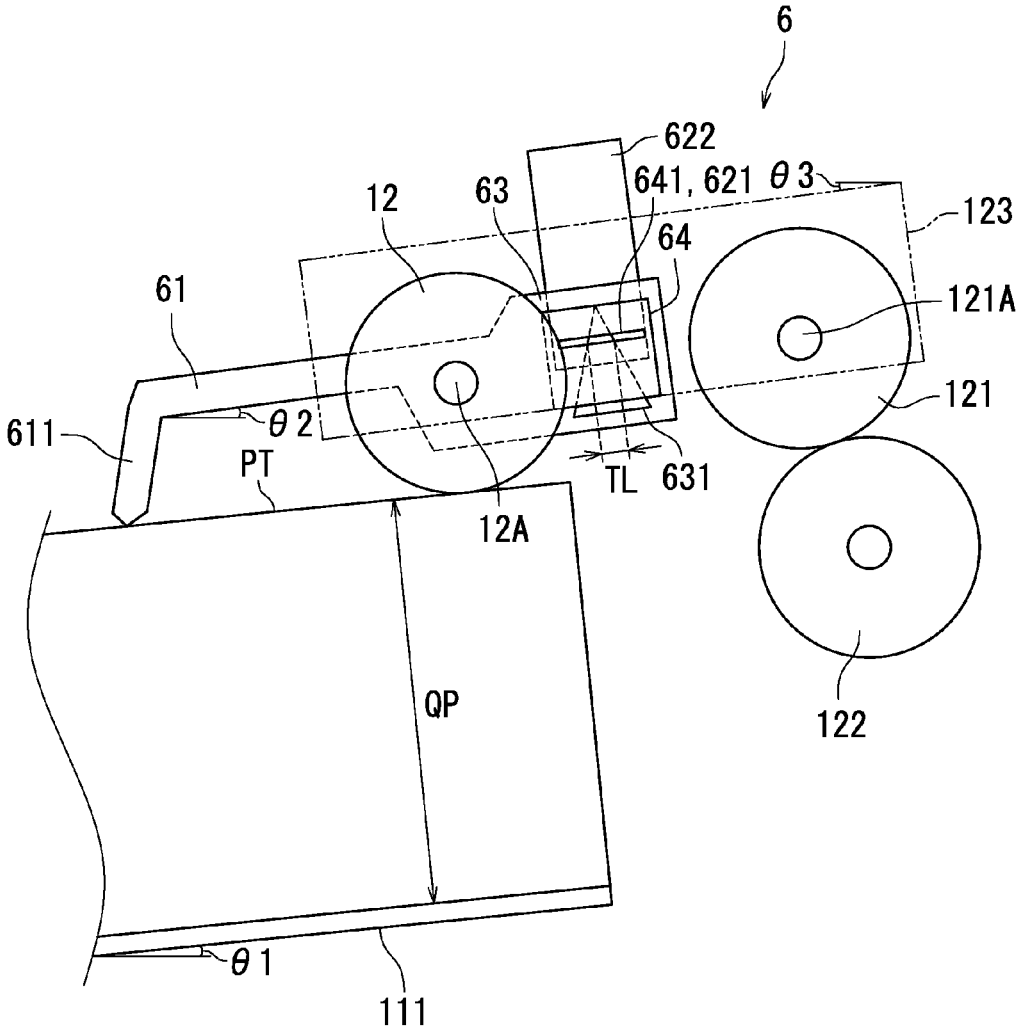
FIG. 3 is a side view illustrating a residual amount detector according to an embodiment of the present disclosure.
Figure 4:
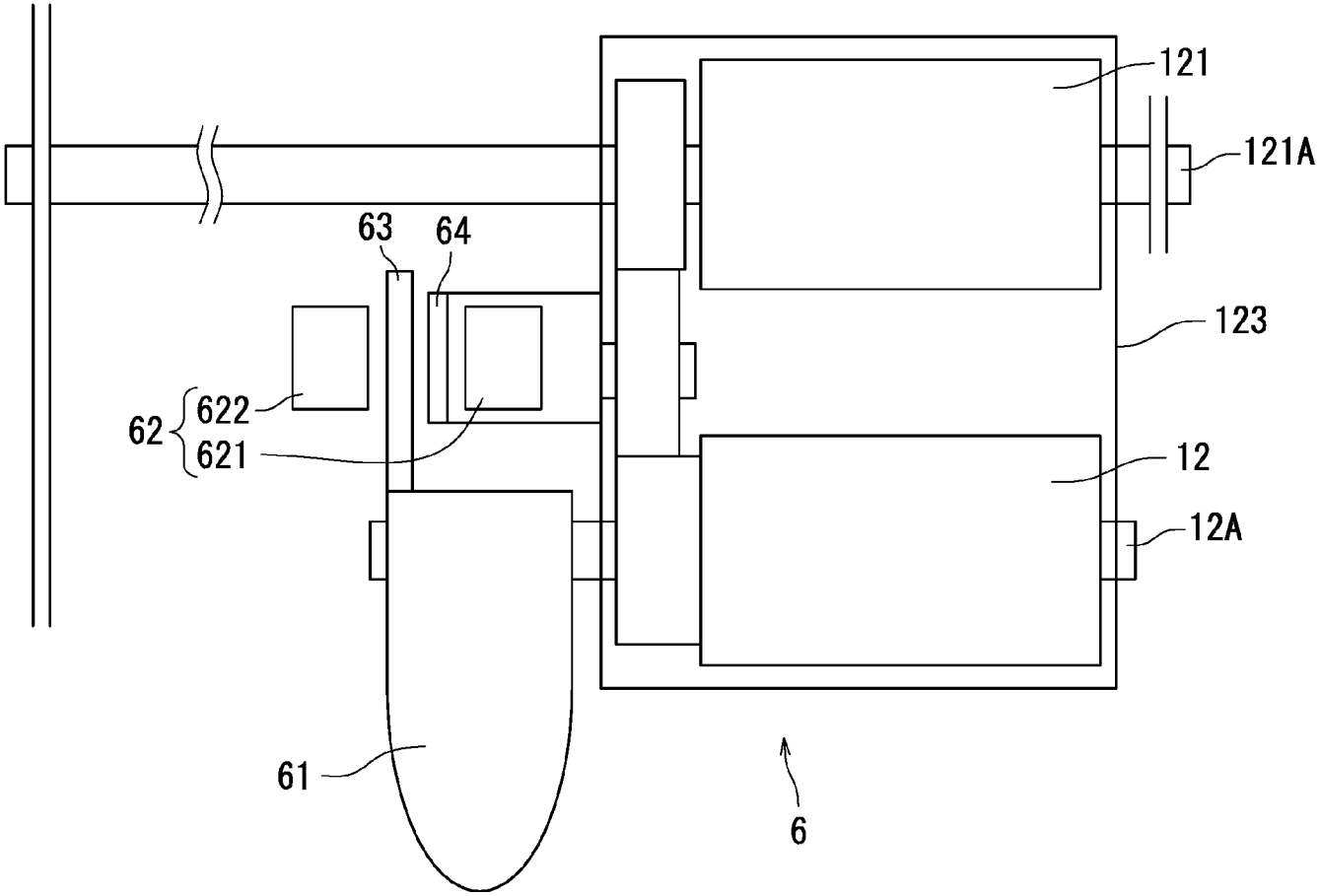
FIG. 4 is a plan view illustrating the residual amount detector according to the embodiment of the present disclosure.

Next, configuration of a residual amount detector 6 according to the embodiment of the present disclosure will be described with reference to FIGS. 1 to 4. FIG. 3 is a side view illustrating the residual amount detector 6. FIG. 4 is a plan view illustrating the residual amount detector 6. As illustrated in FIGS. 3 and 4, the residual amount detector 6 includes an actuator 61 and a photosensor 62.

As illustrated in FIG. 3, the lift plate 111 is driven to increase a first inclination angle θ1 in response to a decrease in a residual amount QP of the paper P. The first inclination angle θ1 indicates an angle of inclination of the lift plate 111 with respect to a horizontal plane.

The photosensor 62 detects a transmitted light quantity QL. As illustrated in FIG. 4, the photosensor 62 includes a light projector 621 and a light receiver 622. The photosensor 62 is fixed to the feeding cassette 11. Also, the light projector 621 has a long thin shape. The feeding cassette 11 corresponds to a "housing".

As illustrated in FIG. 3, the actuator 61 is configured to be turnable about a rotation shaft 12A of the pickup roller 12. A second inclination angle θ2 of the actuator 61 increases in response to an increase in the first inclination angle θ1. The second inclination angle θ2 indicates an angle of inclination of the actuator 61 with respect to the horizontal plane.

The actuator 61 increases or decreases the transmitted light quantity QL along with an increase in the second inclination angle θ2. Specifically, the actuator 61 includes a distal end portion 611 and a first light shield plate 63. The distal end portion 611 is located upstream of the pickup roller 12 in the feeding direction of the paper P and urged to be in contact with an upper surface PT of the paper P.

Specifically, as illustrated in FIG. 4, a portion of the actuator 61 located upstream of the rotation shaft 12A of the pickup roller 12 in the feeding direction of the paper P has a large width. Therefore, the portion of the actuator 61 located upstream of the rotation shaft 12A of the pickup roller 12 in the feeding direction of the paper P is heavier than a portion of the actuator 61 located downstream of the rotation shaft 12A of the pickup roller 12 in the feeding direction of the paper P. Therefore, the actuator 61 turns about the rotation shaft 12A of the pickup roller 12 such that the distal end portion 611 comes close to the upper surface PT of the paper P. As a result, the distal end portion 611 is urged to be in contact with the upper surface PT of the paper P.

The first light shield plate 63 is located downstream of the pickup roller 12 in the feeding direction of the paper P. Also, the first light shield plate 63 is located between the light projector 621 and the light receiver 622 as illustrated in FIG. 4, and blocks a part of light emitted from the light projector 621. Specifically, the first light shield plate 63 has a first opening 631 through which a part of the light emitted from the light projector 621 passes. The first opening 631 is formed such that the transmitted light quantity QL increases or decreases depending on the value of the second inclination angle θ2. Specifically, the first opening 631 has the shape of an isosceles triangle having a base substantially parallel to a plane including a center axis of a rotation shaft 121A of the feeding roller 121 and a center axis of the rotation shaft LA of the pickup roller 12.

As described above, the first light shield plate 63 has the first opening 631 through which a part of the light emitted from the light projector 621 passes. Further, the first opening 631 is formed such that the transmitted light quantity QL increases or decreases depending on the value of the second inclination angle θ2. Therefore, the actuator 61 can be realized with simple configuration.

The residual amount detector 6 further includes a second light shield plate 64. The second light shield plate 64 is located between the light projector 621 and the light receiver 622 and blocks a part of the light emitted from the light projector 621. The second light shield plate 64 is fixed to the support member 123. The second light shield plate 64 has a second opening 641 through which a part of the light emitted from the light projector 621 passes. The second opening 641 is formed such that the transmitted light quantity QL increases or decreases depending on the value of the second inclination angle θ2. The second opening 641 has the shape of a slit substantially parallel to the plane including the center axis of the rotation shaft 121A of the feeding roller 121 and the center axis of the rotation shaft 12A of the pickup roller 12.

As described above, the second light shield plate 64 has the second opening 641 through which a part of the light emitted from the light projector 621 passes. Further, the second opening 641 is formed such that the transmitted light quantity QL increases or decreases depending on the value of the second inclination angle θ2. Therefore, the controller 5 is capable of calculating the residual amount of the paper P on the basis of the transmitted light quantity QL because the transmitted light quantity QL increases or decreases depending on value of the second inclination angle θ2.

Also, the first light shield plate 63 is configured to be turnable about the rotation shaft 12A of the pickup roller 12, and the distal end portion 611 of the actuator 61 located far from the feeding roller 121 is urged to be in contact with the upper surface PT of the paper P. Therefore, the second inclination angle θ2 increases along with an increase in the first inclination angle θ1. Also, the second opening 641 has the shape of a slit substantially parallel to the plane including the center axis of the rotation shaft 121A of the feeding roller 121 and the center axis of the rotation shaft 12A of the pickup roller 12. The first opening 631 has the shape of an isosceles triangle having a base substantially parallel to the plane including the center axis of the rotation shaft 121A of the feeding roller 121 and the center axis of the rotation shaft LA of the pickup roller 12.

Therefore, as the second inclination angle θ2 increases, an angle between the base of the first opening 631 and the second opening 641 increases, and consequently, a length TL of overlapping of the first opening 631 and the second opening 641 increases. Therefore, as the second inclination angle θ2 increases, the transmitted light quantity QL increases. As a result, the controller 5 is capable of calculating the residual amount QP of the paper P on the basis of the transmitted light quantity QL.

The light projector 621 is located opposite to the second opening 641. Also, the light projector 621 has a long thin shape and the second opening 641 has the shape of a slit. When the residual amount QP of the paper P decreases, the pickup roller 12 descends. Further, a third inclination angle θ3 increases and the second opening 641 moves downwards relative to the light projector 621. As a result, the transmitted light quantity QL decreases. The third inclination angle θ3 indicates an angle between an edge of the support member 123 substantially parallel to the feeding direction of the paper P and the horizontal plane.

On the other hand, in order that the pickup roller 12 stably feeds the paper P to the feeding roller 121, it is preferable that the height of the pickup roller 12 does not change even when the residual amount QP of the paper P decreases. Therefore, the controller 5 increases or decreases the first inclination angle θ1 of the lift plate 111 to maintain the third inclination angle θ3 constant even when the residual amount QP of the paper P changes.

Specifically, when the residual amount QP of the paper P decreases, the controller 5 drives the lift plate 111 to increase the first inclination angle θ1, and stops driving the lift plate 111 when the transmitted light quantity QL reaches a maximal value. When the transmitted light quantity QL reaches the maximal value, the second opening 641 reaches a position opposite to the light projector 621. Therefore, by stopping driving the lift plate 111 when the transmitted light quantity QL reaches the maximal value, the third inclination angle θ3 can be maintained constant.

As described above, when the residual amount QP of the paper P decreases, the controller 5 drives the lift plate 111 to increase the first inclination angle θ1, and stops driving the lift plate 111 when the transmitted light quantity QL reaches the maximal value. Therefore, there is no need to provide a sensor for detecting an upper limit of the pickup roller 12. Therefore, the upper limit of the pickup roller 12 can be detected with simple configuration.

The controller 5 calculates the residual amount QP of the paper P on the basis of the transmitted light quantity QL. The residual amount QP indicates for example a thickness of the paper P placed on the lift plate 111. Specifically, the controller 5 is capable of calculating the residual amount QP of the paper P as described below. That is, the controller 5 initially calculates the second inclination angle θ2 on the basis of the transmitted light quantity QL. Next, the controller 5 calculates the first inclination angle θ1 on the basis of the second inclination angle θ2. Then, the controller 5 calculates the residual amount QP of the paper P on the basis of the first inclination angle θ1.

As described above with reference to FIGS. 1 to 4, in the present embodiment, the second inclination angle θ2 increases in response to an increase in the first inclination angle θ1. Also, the actuator 61 increases or decreases the transmitted light quantity QL along with an increase in the second inclination angle θ2. The photosensor 62 detects the transmitted light quantity QL. Further, the controller 5 calculates the residual amount QP of the paper P on the basis of the transmitted light quantity QL. Therefore, the residual amount QP of the paper P can be detected by the actuator 61, the photosensor 62, and the controller 5 without using an encoder. As a result, the residual amount QP of the paper P can be detected with simple configuration.

Figure 5:
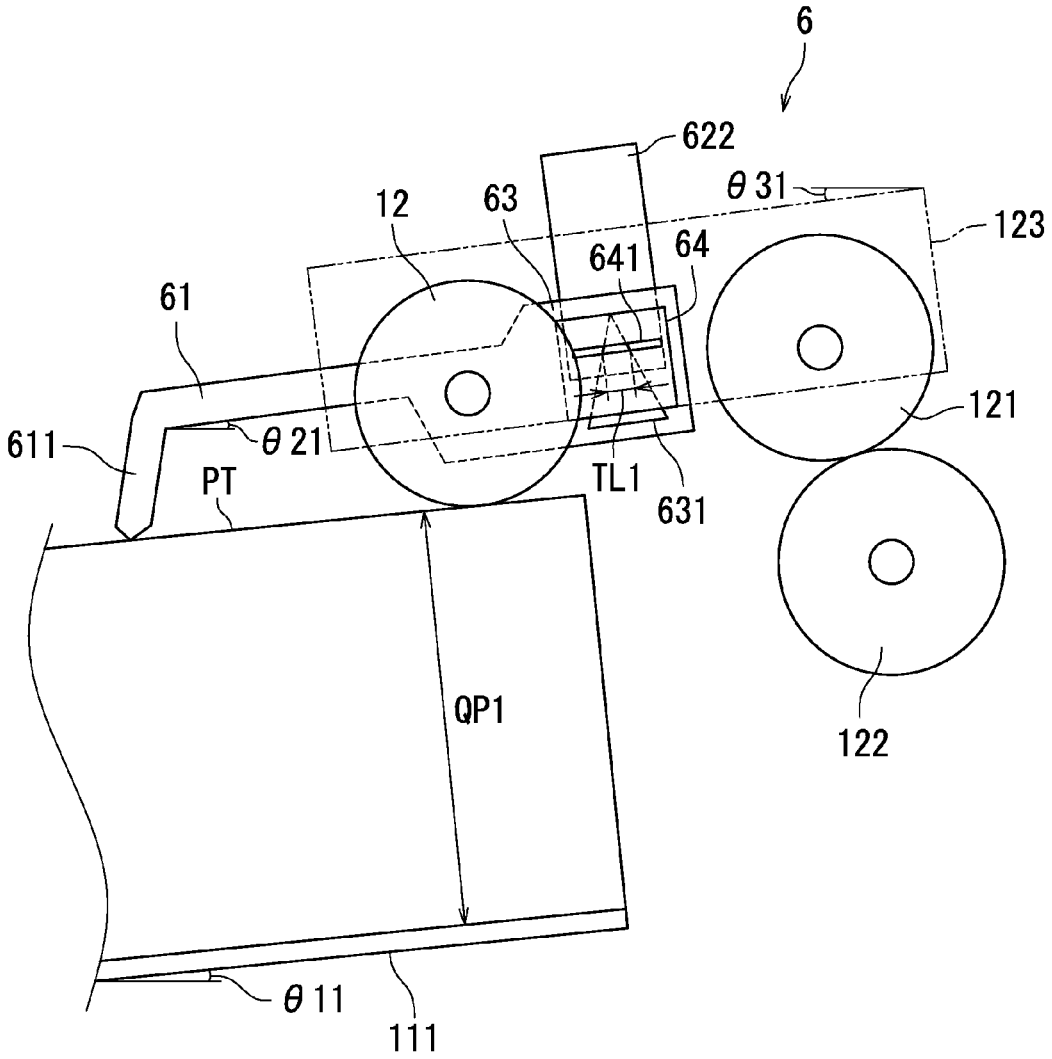
FIG. 5 is a side view illustrating an initial state of the residual amount detector.

Next, the following describes with reference to FIGS. 1 to 7B change of a state of the residual amount detector 6 along a decrease in the residual amount QP of the paper P. FIG. 5 is a side view illustrating an initial state of the residual amount detector 6.

In the initial state, a specific number of sheets (for example 500 sheets) of the paper P are placed on the lift plate 111. As illustrated in FIG. 5, the residual amount QP of the paper P is a residual amount QP1. The first inclination angle θ1 is a first inclination angle θ11. The second inclination angle θ2 is a second inclination angle θ21. The third inclination angle θ3 is a third inclination angle θ31. In the present embodiment, when the third inclination angle θ3 is the third inclination angle θ31, the light projector 621 is located opposite to the second opening 641. The length TL is a length TL1. Note that in the initial state, the base of the first opening 631 is substantially parallel to the second opening 641, and the length TL is the length TL1.

Figure 6A:
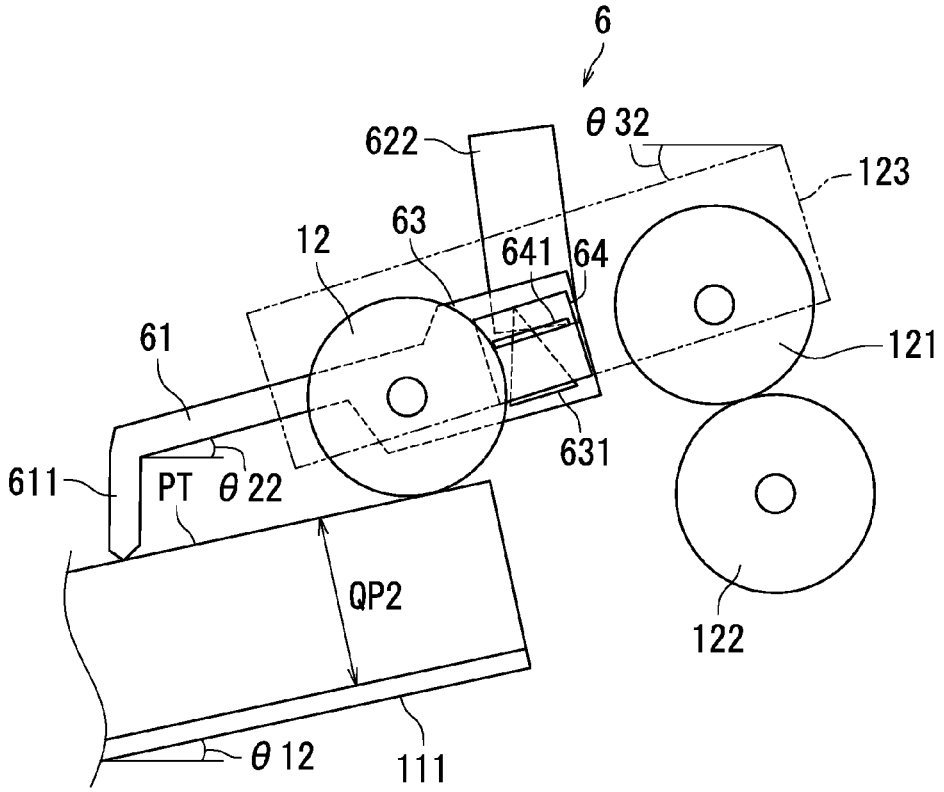
FIG. 6A is a side view illustrating the residual amount detector when a residual amount of paper has decreased.
Figure 6B:
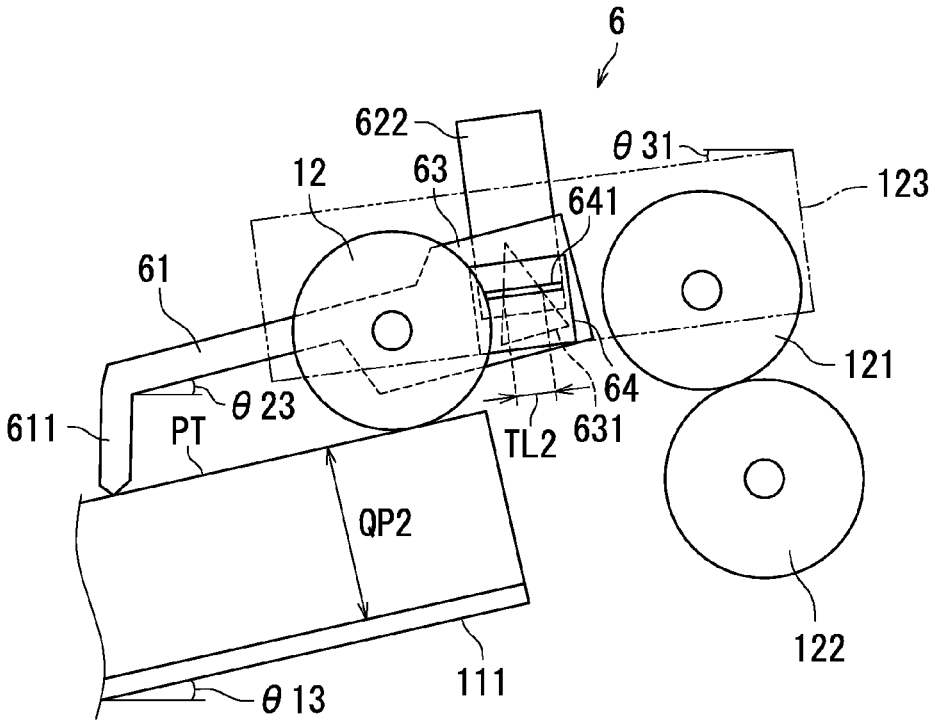
FIG. 6B is a side view illustrating the residual amount detector after a first inclination angle has been increased.

FIG. 6A is a side view illustrating the residual amount detector 6 when the residual amount QP of the paper P has decreased. FIG. 6B is a side view illustrating the residual amount detector 6 after the first inclination angle θ1 has been increased.

As illustrated in FIG. 6A, the residual amount QP of the paper P has decreased from the residual amount QP1 illustrated in FIG. 5 to a residual amount QP2. As a result, the pickup roller 12 descends and the third inclination angle θ3 increases from the third inclination angle θ31 illustrated in FIG. 5 to a third inclination angle θ32. In this state, the pickup roller 12 is unable to stably feed the paper P to the feeding roller 121. Therefore, the controller 5 increases the first inclination angle θ1 to make the third inclination angle θ3 indicate a constant value the third inclination angle θ31).

Specifically, as illustrated in FIG. 6B, the controller 5 increases the first inclination angle θ1 from the first inclination angle θ12 illustrated in FIG. 6A to a first inclination angle θ13 so that the third inclination angle θ3 becomes the third inclination angle θ31. Along with this, the pickup roller 12 is elevated. By contrast, the distal end portion 611 remains in contact with the upper surface PT of the paper P. As a result, the second inclination angle θ2 increases from the second inclination angle θ21 illustrated in FIG. 5 to a second inclination angle θ23 (θ23>θ21). Further, an angle between the base of the first opening 631 and a longitudinal center line of the second opening 641 increases, and the length TL increases to a length TL2 (TL2>TL1). As a result, the transmitted light quantity QL increases as compared with the transmitted light quantity QL in the initial state.

Figure 7A:
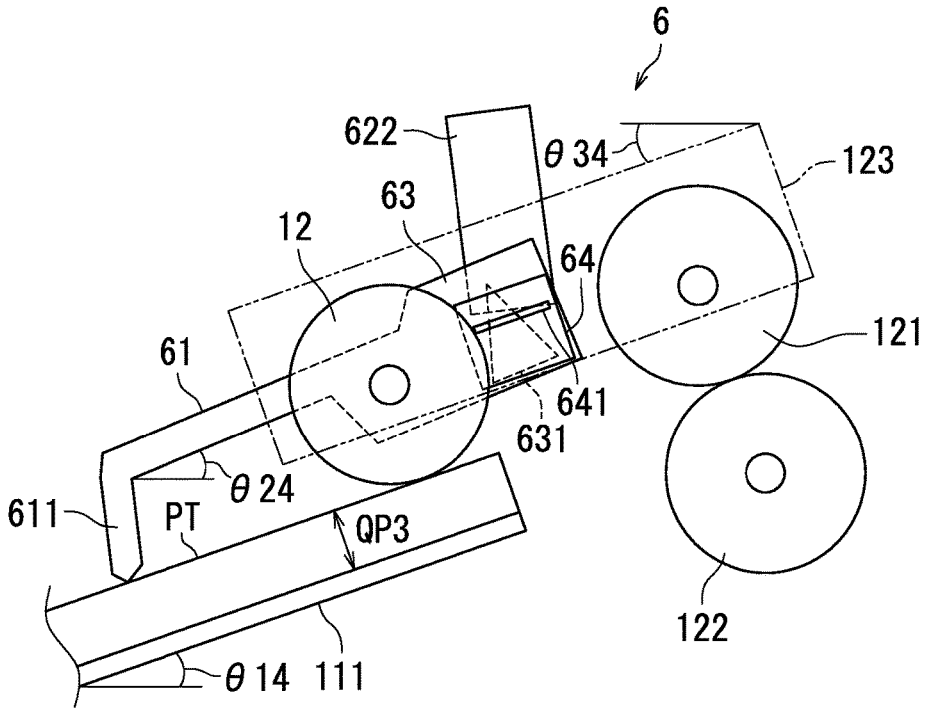
FIG. 7A is a side view illustrating the residual amount detector when the residual amount of the paper has further decreased.
Figure 7B:
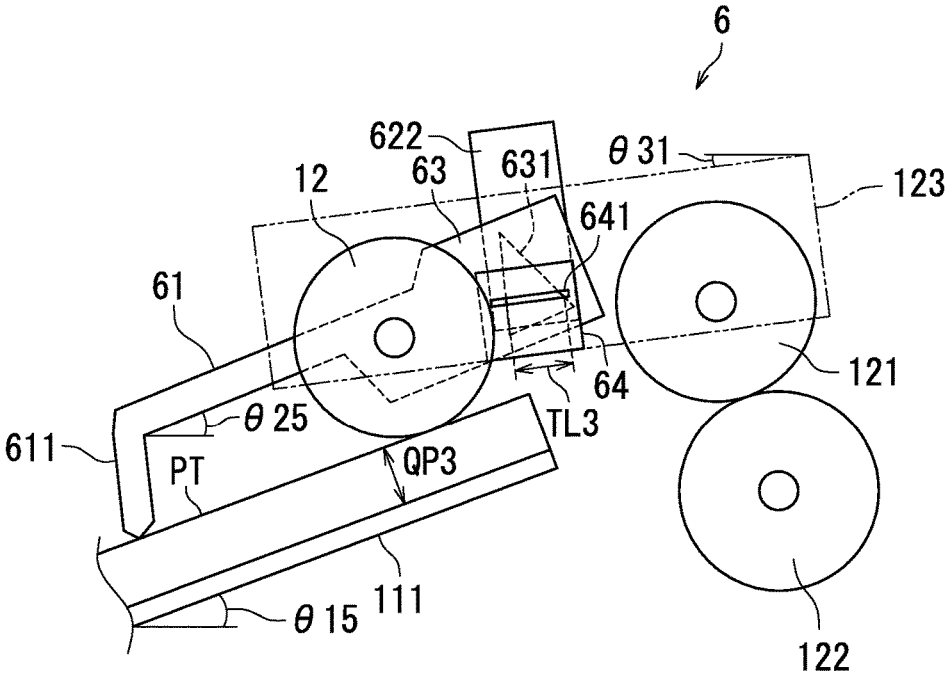
FIG. 7B is a side view illustrating the residual amount detector after the first inclination angle has been further increased.

FIG. 7A is a side view illustrating the residual amount detector 6 when the residual amount QP of the paper P has further decreased. FIG. 7B is a side view illustrating the residual amount detector 6 after the first inclination angle θ1 has been further increased.

As illustrated in FIG. 7A, the residual amount QP of the paper P has further decreased from the residual amount QP2 illustrated in FIG. 6B to a residual amount QP3. As a result, the pickup roller 12 descends and the third inclination angle θ3 increases from the third inclination angle θ31 illustrated in FIG. 6B to a third inclination angle θ34. In this state, the pickup roller 12 is unable to stably feed the paper P to the feeding roller 121. Therefore, the controller 5 increases the first inclination angle θ1 so that the third inclination angle θ3 becomes the constant value (i.e., the third inclination angle θ31).

Specifically, as illustrated in FIG. 7B, the controller 5 increases the first inclination angle θ1 from the first inclination angle θ14 illustrated in FIG. 7A to a first inclination angle θ15 so that the third inclination angle θ3 becomes the third inclination angle θ31. Along with this, the pickup roller 12 is elevated. By contrast, the distal end portion 611 remains in contact with the upper surface PT of the paper P. As a result, the second inclination angle θ2 increases from the second inclination angle θ23 illustrated in FIG. 6B to a second inclination angle θ25 (θ25>θ23). Further, an angle between the base of the first opening 631 and the longitudinal center line of the second opening 641 further increases, and the length TL increases to a length TL3 (TL3>TL2). As a result, the transmitted light quantity QL further increases as compared with the transmitted light quantity QL in the state illustrated in FIG. 6B.

As described above with reference to FIGS. 1 to 7B, in the present embodiment, the controller 5 increases the first inclination angle θ1 in response to a decrease in the residual amount QP of the paper P to make the third inclination angle θ3 indicate the constant value (i.e., the third inclination angle θ31). Also, the second inclination angle θ2 increases and the length TL increases in response to the decrease in the residual amount QP of the paper P. As a result, the transmitted light quantity QL increases.

Therefore, the controller 5 is capable of determining the residual amount QP by calculating the second inclination angle θ2 from the transmitted light quantity QL, calculating the first inclination angle θ1 from the second inclination angle θ2, and calculating the residual amount QP from the first inclination angle θ1.

Figure 8A:
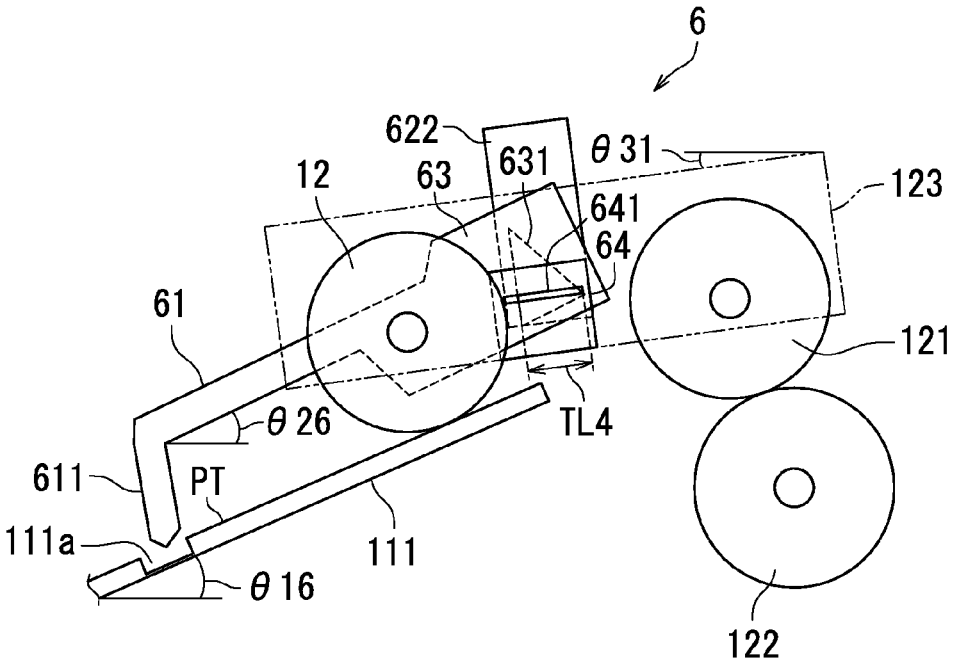
FIG. 8A is a side view illustrating the residual amount detector when the residual amount of the paper has decreased to one and the first inclination angle has been further increased.
Figure 8B:
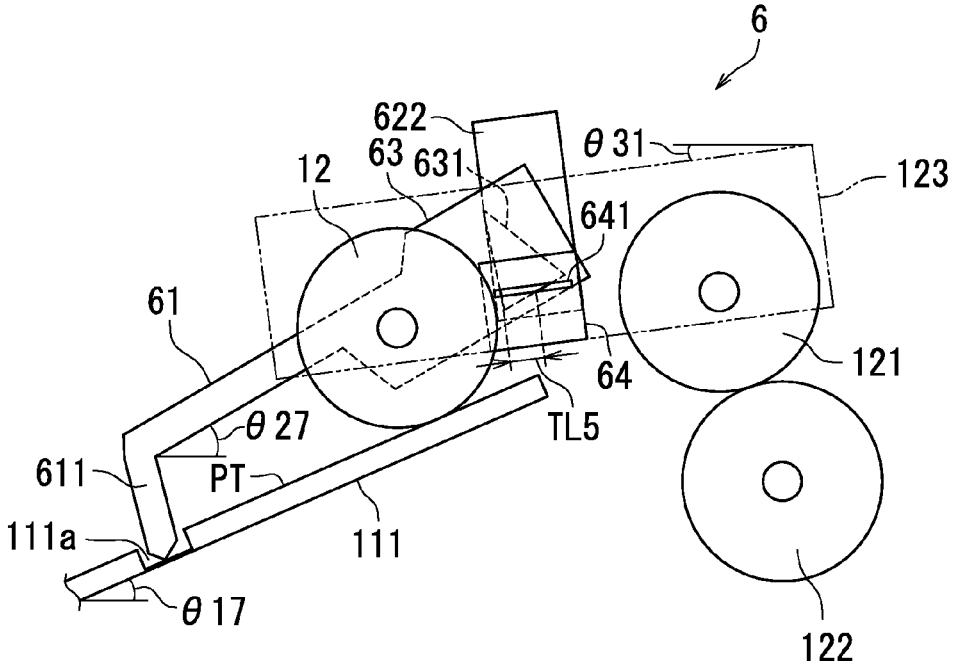
FIG. 8B is a side view illustrating the residual amount detector when the residual amount of the paper is zero.

Next, the following describes configuration for detecting absence of the paper P with reference to FIGS. 1 to 4, 8A, and 8B. FIG. 8A is a side view illustrating the residual amount detector 6 when the residual amount QP of the paper P has decreased to one and the first inclination angle θ1 has been further increased. FIG. 8B is a side view illustrating the residual amount detector 6 when the residual amount QP of the paper P is zero.

As illustrated in FIG. 8A, when the residual amount QP of the paper P decreases to one, the first inclination angle θ1 increases from the first inclination angle θ15 illustrated in FIG. 7B to a first inclination angle θ16 so that the third inclination angle θ3 becomes the constant value (i.e., the third inclination angle θ31). As a result, the second inclination angle θ2 increases from the second inclination angle θ25 illustrated in FIG. 7B to a second inclination angle θ26 (θ26>θ25). Further, an angle between the base of the first opening 631 and the longitudinal center line of the second opening 641 further increases, and the length TL increases to a length TL4 (TL4>TL3). As a result, the transmitted light quantity QL further increases as compared with the transmitted light quantity QL in the state illustrated in FIG. 7B.

As illustrated in FIG. 8B, the lift plate 111 has a recess 111*a*. The recess 111*a* is formed in an upper surface of the lift plate 111. Also, the recess 111*a* is formed at a position opposite to the distal end portion 611. Further, the recess 111*a* is formed such that the distal end portion 611 is capable of entering the inside of the recess 111*a*. Therefore, when the residual amount QP of the paper P becomes zero, the distal end portion 611 enters the inside of the recess 111*a*.

As a result, the second inclination angle θ2 increases from the second inclination angle θ26 illustrated in FIG. 8A to a second inclination angle θ27 (θ27>θ26). Further, an angle between the base of the first opening 631 and the longitudinal center line of the second opening 641 further increases, and the length TI, decreases to a length TL5 (TL5<TL4). As a result, the transmitted light quantity QL decreases as compared with the transmitted light quantity QL in the state illustrated in FIG. 8A.

On the basis of the transmitted light quantity QL, the controller 5 determines whether or not the distal end portion 611 has entered the inside of the recess 111*a*. When determining that the distal end portion 611 has entered the inside of the recess 111*a* the controller 5 determines that the paper P is absent.

As described above with reference to FIGS. 1 to 4, 8A, and 8B, in the present embodiment, the recess 111*a* inside of which the distal end portion 611 is capable of entering is formed in the lift plate 111 at a position opposite to the distal end portion 611. Also, the controller 5 determines whether or not the distal end portion 611 has entered the inside of the recess 111*a* on the basis of the transmitted light quantity QL.

When determining that the distal end portion 611 has entered the inside of the recess 111*a*, the controller 5 determines that the paper P is absent. Therefore, there is no need to provide a sensor for detecting presence or absence of the paper P. Therefore, presence or absence of the paper P can be detected with simple configuration.

Figure 9:
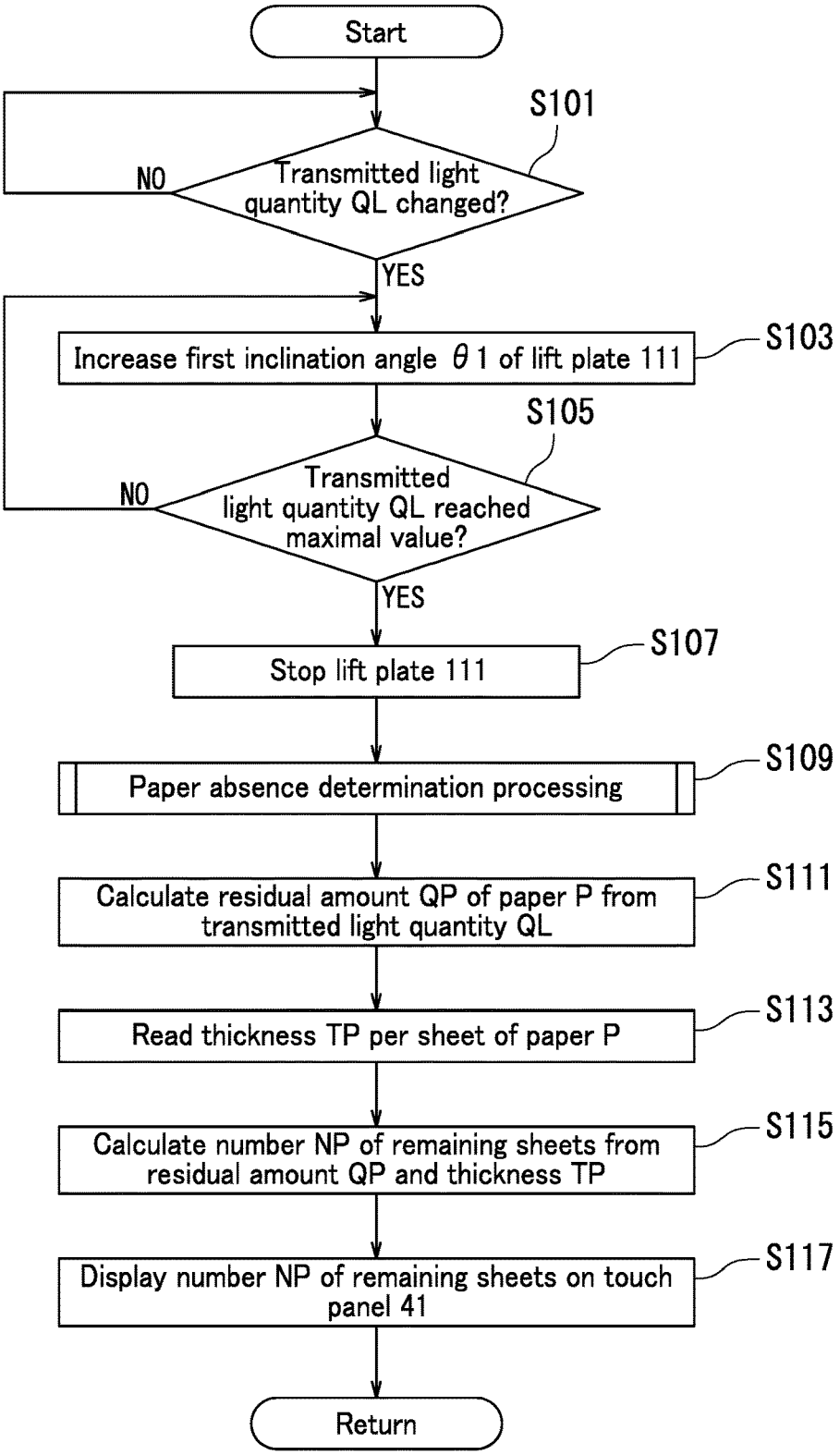
FIG. 9 is a flowchart illustrating processing performed by a controller.

Next, the following describes with reference to FIGS. 1 to 9 processing performed by the controller 5. FIG. 9 is a flowchart illustrating the processing performed by the controller 5. Note that the thickness TP per sheet of the paper P is stored in the storage 5B (see FIG. 1) in advance.

As illustrated in FIG. 9, at step S101, the controller 5 initially determines whether or not the transmitted light quantity QL has changed. Specifically, when the paper P is consumed and the pickup roller 12 descends, the third inclination angle θ3 increases and the second opening 641 moves downwards relative to the light projector 621. As a result, the transmitted light quantity QL decreases.

When the controller 5 determines that the transmitted light quantity QL has not changed (NO at step S101), the processing is suspended. When the controller 5 determines that the transmitted light quantity QL has changed (YES at step S101), the processing proceeds to step S103.

Next, at step S103, the controller 5 elevates the lift plate 111 and increases the first inclination angle θ1.

At step S105, the controller 5 determines whether or not the transmitted light quantity QL has reached a maximal value. Specifically, while the first inclination angle θ1 is being increased, when the transmitted light quantity QL that has been increasing starts to decrease, the controller 5 determines that the transmitted light quantity QL has reached the maximal value.

When the controller 5 determines that the transmitted light quantity QL has not reached the maximal value (NO at step S105), the processing returns to step S103. When the controller 5 determines that the transmitted light quantity QL has reached the maximal value (YES at step S105), the processing proceeds to step S107.

At step S107, the controller 5 stops the elevation of the lift plate 111. At this time, the second opening 641 is located opposite to the light projector 621, and the pickup roller 12 has been moved to a proper position.

At step S109, the controller 5 performs "paper absence determination processing". The "paper absence determination processing" refers to processing for determining whether or not the residual amount QP of the paper P is zero.

Next, at step S111, the controller 5 calculates the residual amount QP of the paper P from the transmitted light quantity QL.

At step S113, the controller 5 reads out the thickness TP per sheet of the paper P.

Next at step S115, the controller 5 calculates the number NP of remaining sheets of the paper P from the residual amount QP and the thickness TP.

At step S117, the controller 5 causes the touch panel 41 to display the number NP of the remaining sheets, and ends the processing.

As described above with reference to FIGS. 1 to 9, in the present embodiment, the controller 5 calculates the number NP of the remaining sheets of the paper P on the basis of the residual amount QP of the paper P and the thickness TP per sheet of the paper P. Further, the controller 5 causes the touch panel 41 to display the number NP of the remaining sheets. Therefore, the user can check the number NP of the remaining sheets of the paper P. Therefore, user friendliness is improved.

Figure 10:
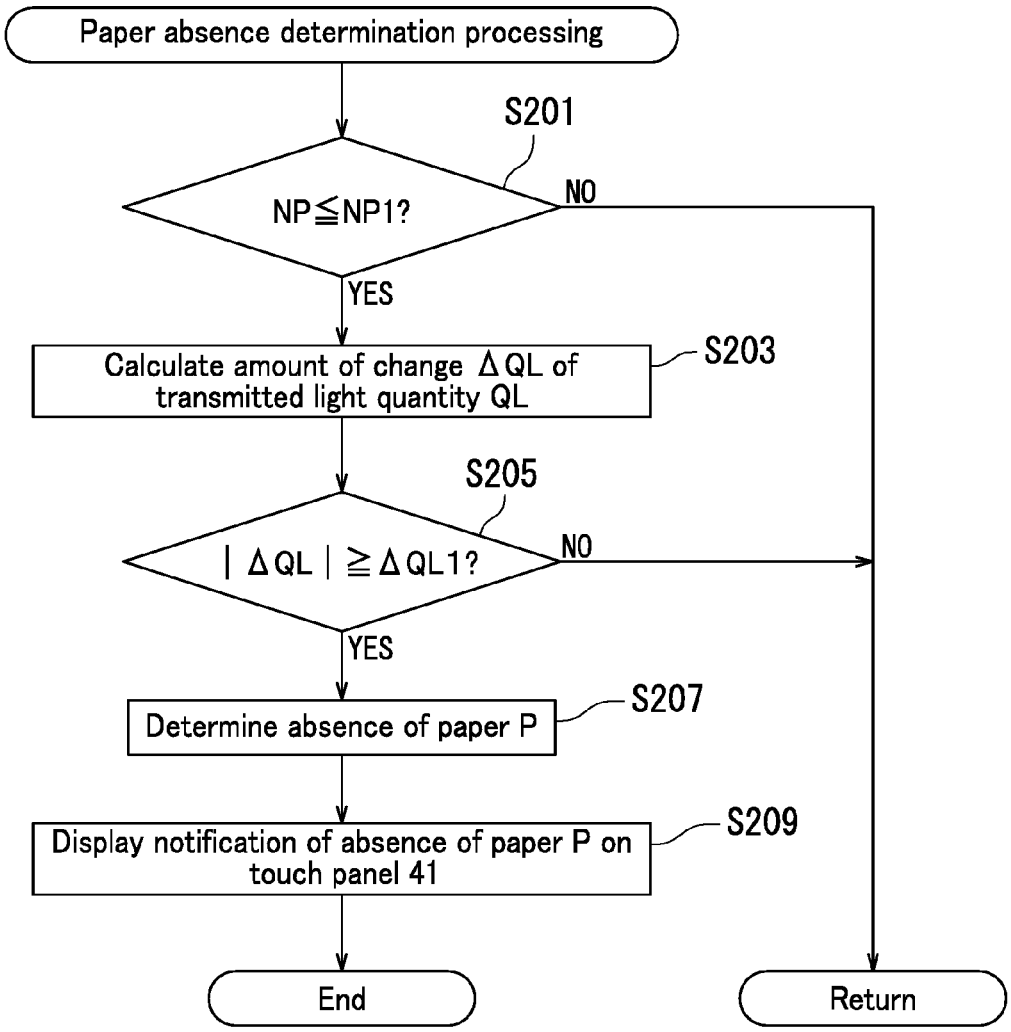
FIG. 10 is a flowchart illustrating paper absence determination processing performed by the controller.

Next, the following describes the "paper absence determination processing" with reference to FIGS. 1 to 10. FIG. 10 is a flowchart illustrating the paper absence determination processing performed by the controller 5.

As illustrated in FIG. 10, at step S201, the controller 5 determines whether or not the number NP of the remaining sheets is equal to or less than a predetermined number NP1. The predetermined number NP1 is for example five.

When the controller 5 determines that the number NP of the remaining sheets is larger than the predetermined number NP1 (NO at step S201), the processing proceeds to step S111 in FIG. 9. When the controller 5 determines that the number NP of the remaining sheets is equal to or less than the predetermined number NP1 (YES at step S201), the processing proceeds to step S203.

At step S203, the controller 5 calculates an amount of change ΔQL of the transmitted light quantity QL. The amount of change ΔQL indicates a difference between a previously detected transmitted light quantity QL and a currently detected transmitted light quantity QL.

Next at step S205, the controller 5 determines whether or not an absolute value of the amount of change ΔQL is equal to or larger than a threshold value ΔQL1.

When the controller 5 determines that the absolute value of the amount of change ΔQL is smaller than the threshold value ΔQL1 (NO at step S205), the processing proceeds to step S111 in FIG. 9. When the controller 5 determines that the absolute value of the amount of change ΔQL is equal to or larger than the threshold value ΔQL1 (YES at step S205), the processing proceeds to step S207.

At step S207, the controller 5 determines that the paper P is absent.

Next at step S209, the controller 5 causes the touch panel 41 to display notification of the absence of the paper P, and ends the processing.

As described above with reference to FIGS. 1 to 10, in the present embodiment, the distal end portion 611 enters the inside of the recess 111*a* when the paper P is absent. As a result, the transmitted light quantity QL changes stepwise. Therefore, the controller 5 is capable of determining absence of the paper P depending on whether or not an absolute value of the amount of change ΔQL is equal to or larger than the threshold value ΔQL1. Therefore, there is no need to provide a sensor for detecting presence or absence of the paper.

Through the above, the embodiment of the present disclosure has been described with reference to the drawings. However, it should be noted that the present disclosure is not limited to the above embodiment and is practicable in various manners within a scope not departing from the gist of the present disclosure (for example, as described below in sections (1) to (5)). The drawings schematically illustrate elements of configuration in order to facilitate understanding, and properties of elements of configuration illustrated in the drawings, such as thicknesses, lengths, and numbers thereof, may differ from actual properties thereof in order to facilitate preparation of the drawings. Also, properties of elements of configuration described in the above embodiment, such as shapes and dimensions thereof, are merely examples and are not intended as specific limitations. Various alterations may be made within a scope not substantially departing from the configuration of the present disclosure.

(1) As described above with reference to FIG. 1, the image forming apparatus 100 is a multifunction peripheral. However, the present disclosure is not limited to this configuration. It is only required that the image forming apparatus includes the image forming device. For example, the image forming apparatus may be a color printer. Alternatively, the image forming apparatus may be for example a monochrome copier.

(2) As described above with reference to FIG. 3, the light projector 621 has a long thin shape and the light receiver 622 does not have a long thin shape. However, the present disclosure is not limited to this configuration. It is only required that at least one of the light projector 621 and the light receiver 622 has a long thin shape. For example, it is possible to employ configuration in which the light receiver 622 has a long thin shape and the light projector 621 does not have a long thin shape. Alternatively, it is possible to employ configuration in which the light projector 621 and the light receiver 622 each have a long thin shape.

(3) As described above with reference to FIG. 3, the first opening 631 has the shape of an isosceles triangle. However, the present disclosure is not limited to this configuration. It is only required that the first opening is formed such that the transmitted light quantity QL increases or decreases along with an increase in the second inclination angle θ2. For example, the first opening may have the shape of a trapezoid. Alternatively, the first opening may for example have the shape of a right triangle.

(4) As described above with reference to FIG. 3, the second opening has the shape of a slit. However, the present disclosure is not limited to this configuration. It is only required that the second opening is formed such that the transmitted light quantity QL increases or decreases along with an increase in the second inclination angle θ2. For example, the second opening may have the shape of a rectangle. In this case, the transmitted light quantity increases and therefore the residual amount QP of the paper P can be detected accurately.

(5) As described above with reference to FIGS. 8A and 8B, the lift plate 111 has the recess 111*a*. However, the present disclosure is not limited to this configuration. It is only required that the second inclination angle θ2 changes stepwise when the paper P becomes absent. For example, it is possible to employ configuration in which a hole into which the distal end portion 611 can be inserted is formed in the lift plate at a position opposite to the distal end portion 611.

What is claimed is:

1. An image forming apparatus comprising:

a lift plate configured to be driven to increase a first inclination angle in response to a decrease in a residual amount of a recording medium placed on the lift plate, the first inclination angle indicating an angle of inclination of the lift plate with respect to a horizontal plane;

an actuator configured to increase a second inclination angle in response to an increase in the first inclination angle, the second inclination angle indicating an angle of inclination of the actuator with respect to the horizontal plane;

a photosensor configured to detect a transmitted light quantity; and a controller configured to calculate the residual amount of the recording medium on the basis of the transmitted light quantity, wherein the actuator increases or decreases the transmitted light quantity along with an increase in the second inclination angle, the photosensor includes a light projector and a light receiver, the actuator is located between the light projector and the light receiver, and has a first light shield plate that blocks a part of light emitted from the light projector, the first light shield plate has a first opening through which a part of the light emitted from the light projector passes, the first opening is configured to increase or decrease the transmitted light quantity depending on a value of the second inclination angle, the image forming apparatus further comprising:

an image forming device configured to form an image on the recording medium;

a conveyance device configured to convey the recording medium to the image forming device;

a feeding roller configured to feed the recording medium to the conveyance device; and a pickup roller configured to feed the recording medium placed on the lift plate to the feeding roller, wherein the actuator is configured to be turnable about a rotation shaft of the pickup roller, the actuator includes a distal end portion located far from the feeding roller, and the distal end portion is urged to be in contact with an upper surface of the recording medium.

2. The image forming apparatus according to claim 1, further comprising:

a display section; and storage storing therein a thickness per sheet of the recording medium, wherein the controller calculates the number of remaining sheets of the recording medium on the basis of the residual amount of the recording medium and the thickness, and causes the display section to display the number of the remaining sheets.

3. An image forming apparatus comprising:

a lift plate configured to be driven to increase a first inclination angle in response to a decrease in a residual amount of a recording medium placed on the lift plate, the first inclination angle indicating an angle of inclination of the lift plate with respect to a horizontal plane;

an actuator configured to increase a second inclination angle in response to an increase in the first inclination angle, the second inclination angle indicating an angle of inclination of the actuator with respect to the horizontal plane;

a photosensor configured to detect a transmitted light quantity; and a controller configured to calculate the residual amount of the recording medium on the basis of the transmitted light quantity, wherein the actuator increases or decreases the transmitted light quantity along with an increase in the second inclination angle, the photosensor includes a light projector and a light receiver, the actuator is located between the light projector and the light receiver, and has a first light shield plate that blocks a part of light emitted from the light projector, the first light shield plate has a first opening through which a part of the light emitted from the light projector passes, and the first opening is configured to increase or decrease the transmitted light quantity depending on a value of the second inclination angle, the image forming apparatus further comprising:

an image forming device configured to form an image on the recording medium;

a conveyance device configured to convey the recording medium to the image forming device;

a feeding roller configured to feed the recording medium to the conveyance device;

a pickup roller configured to feed the recording medium placed on the lift plate to the feeding roller;

a support member supporting the pickup roller; and a second light shield plate located between the light projector and the light receiver and configured to block a part of the light emitted from the light projector, wherein the pickup roller is supported by the support member to be turnable about a rotation shaft of the feeding roller, the second light shield plate is fixed to the support member, the second light shield plate has a second opening through which a part of the light emitted from the light projector passes, and the second opening is configured to increase or decrease the transmitted light quantity depending on a value of the second inclination angle.

4. The image forming apparatus according to claim 1, wherein the first opening has the shape of an isosceles triangle having a base substantially parallel to a plane including a center axis of a rotation shaft of the feeding roller and a center axis of the rotation shaft of the pickup roller.

5. The image forming apparatus according to claim 4, wherein the lift plate has a recess at a position opposite to the distal end portion, the distal end portion is capable of entering the inside of the recess, the controller determines whether or not the distal end portion has entered the inside of the recess on the basis of the transmitted light quantity, and when determining that the distal end portion has entered the inside of the recess, the controller determines that the recording medium is absent.

6. The image forming apparatus according to claim 5, wherein when the transmitted light quantity has changed stepwise by an amount equal to or larger than a predetermined threshold value, the controller determines that the distal end portion has entered the inside of the recess.

7. The image forming apparatus according to claim 1, further comprising:

a support member supporting the pickup roller; and a second light shield plate located between the light projector and the light receiver and configured to block a part of the light emitted from the light projector, wherein the pickup roller is supported by the support member to be turnable about a rotation shaft of the feeding roller, the second light shield plate is fixed to the support member, the second light shield plate has a second opening through which a part of the light emitted from the light projector passes, and the second opening is configured to increase or decrease the transmitted light quantity depending on a value of the second inclination angle.

8. The image forming apparatus according to claim 7, wherein the second opening has the shape of a slit substantially parallel to a plane including a center axis of the rotation shaft of the feeding roller and a center axis of the rotation shaft of the pickup roller.

9. The image forming apparatus according to claim 8, wherein a length of overlapping of the first opening and the second opening increases or decreases depending on the value of the second inclination angle.

10. The image forming apparatus according to claim 7, further comprising a housing configured to accommodate the recording medium and supporting the lift plate in a manner that the lift plate is turnable, wherein the light projector and the light receiver are fixed to the housing, at least one of the light projector and the light receiver has a long thin shape and is located opposite to the second opening, the controller drives the lift plate to increase the first inclination angle when the residual amount of the recording medium has decreased, and stops driving the lift plate when the transmitted light quantity has reached a maximal value.

11. The image forming apparatus according to claim 3, wherein the lift plate has a recess at a position opposite to the distal end portion, the distal end portion is capable of entering the inside of the recess, the controller determines whether or not the distal end portion has entered the inside of the recess on the basis of the transmitted light quantity, and when determining that the distal end portion has entered the inside of the recess, the controller determines that the recording medium is absent.

12. The image forming apparatus according to claim 11, wherein when the transmitted light quantity has changed stepwise by an amount equal to or larger than a predetermined threshold value, the controller determines that the distal end portion has entered the inside of the recess.

* * * * *